US008545280B1

(12) United States Patent
Patil et al.

(10) Patent No.: US 8,545,280 B1
(45) Date of Patent: Oct. 1, 2013

(54) SPRAY SHIELD FOR SURFACE-PIERCING GEARCASE

(75) Inventors: Sunil K. R. Patil, Troy, MI (US); John O. Scherer, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 124 days.

(21) Appl. No.: 13/087,417

(22) Filed: Apr. 15, 2011

(51) Int. Cl.
*B63H 20/32* (2006.01)
*B63H 20/28* (2006.01)

(52) U.S. Cl.
USPC ..... 440/66; 440/88 M

(58) Field of Classification Search
USPC ..... 440/66, 76, 88 M
See application file for complete search history.

(56) References Cited

U.S. PATENT DOCUMENTS 4,323,355 A * 4/1982 Kondo ..... 440/76
4,781,632 A * 11/1988 Litjens et al. ..... 440/66
4,875,882 A 10/1989 Plitt et al.
4,898,553 A 2/1990 Bankstahl
5,085,603 A * 2/1992 Haluzak ..... 440/51
5,425,663 A 6/1995 Meisenburg et al.
6,048,236 A * 4/2000 Natsume ..... 440/66
6,468,120 B1 * 10/2002 Hasl et al. ..... 440/61 R
8,216,011 B2 * 7/2012 Ogasawara et al. ..... 440/89 R

OTHER PUBLICATIONS

Spray Drag of Surface-Piercing Struts, Richard B. Chapman, Naval Undersea Research and Development Center, San Diego, CA, NUC TP 251, dated Sep. 1971, 28 pgs.

* cited by examiner

*Primary Examiner* — Stephen Avila
*Assistant Examiner* — Andrew Polay
(74) *Attorney, Agent, or Firm* — Andrus, Sceales, Starke & Sawall, LLP

(57) ABSTRACT

A marine drive has a lower drive unit including a gearcase with a vertical strut having a lower horizontal torpedo with an aft propeller. An anti-ventilation plate on the strut is spaced above the torpedo. A spray shield plate on the strut is spaced above the torpedo and below the anti-ventilation plate.

5 Claims, 4 Drawing Sheets

SPRAY SHIELD FOR SURFACE-PIERCING GEARCASE

BACKGROUND AND SUMMARY

The invention relates to marine drives.

Marine drives are known in the prior art, including a lower drive unit including a vertical strut having a lower horizontal torpedo with an aft propeller for propelling a marine vessel. An anti-ventilation plate on the strut is spaced above the torpedo and propeller to prevent entry of air to the propeller. A water deflector splash guard or spray shield or plate above the anti-ventilation plate diverts water away from the powerhead and transom bracket assemblies thereabove during forward operation of the vessel.

The present invention arose during continuing development efforts in the above technology.

DETAILED DESCRIPTION

Marine drives with anti-ventilation plates and splash or spray plates are known in the prior art, for example U.S. Pat. No. 4,875,882 at anti-ventilation plate 31 and spray plate 30, and U.S. Pat. No. 4,781,632 at anti-ventilation plate 22 and splash plate 20, both incorporated herein by reference.

Figure 1:
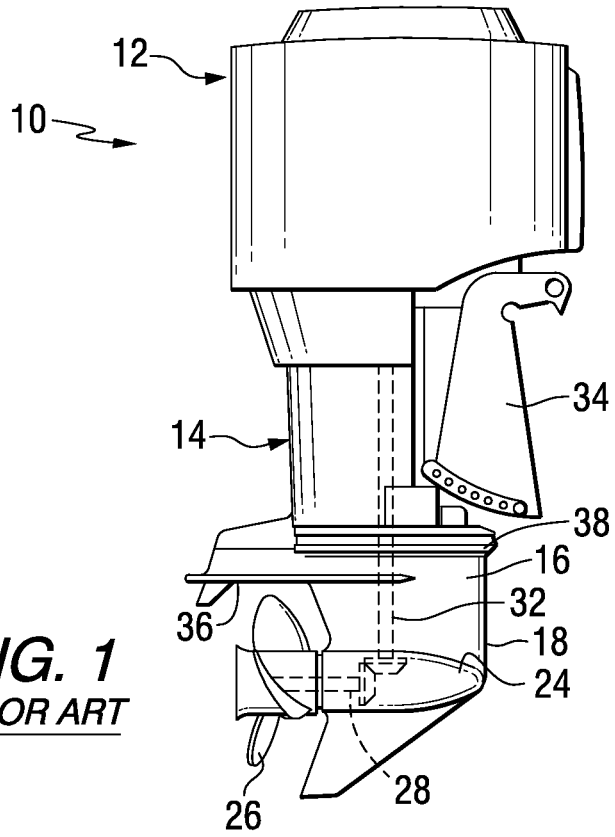
FIG. 1 PRIOR ART
FIG. 1 shows a marine drive known in the prior art, and is taken from U.S. Pat. No. 4,898,553, incorporated herein by reference.

FIG. 1 is taken from U.S. Pat. No. 4,898,553, incorporated herein by reference. FIG. 1 herein shows a marine drive 10 including an upper powerhead 12 and a lower drive unit 14 including a gearcase 16 with a vertical strut 18 having a lower horizontal torpedo 24 with an aft propeller 26 driven by a horizontal propeller shaft 28 which is driven by vertical driveshaft 32, for propelling the vessel through a body of water. The drive is mounted to the transom of the vessel by a transom bracket 34. An anti-ventilation plate 36 is integrally formed on the strut and is spaced above the torpedo and the propeller to prevent entry of air to the propeller, to prevent ventilation. A spray plate or shield 38 is integrally formed on the strut and spaced above the anti-ventilation plate 36 for diverting water away from the powerhead and transom bracket assemblies during forward operation of the vessel. The structure described thus far is known in the prior art, for which further reference may be had to the noted incorporated patents.

Figure 2:
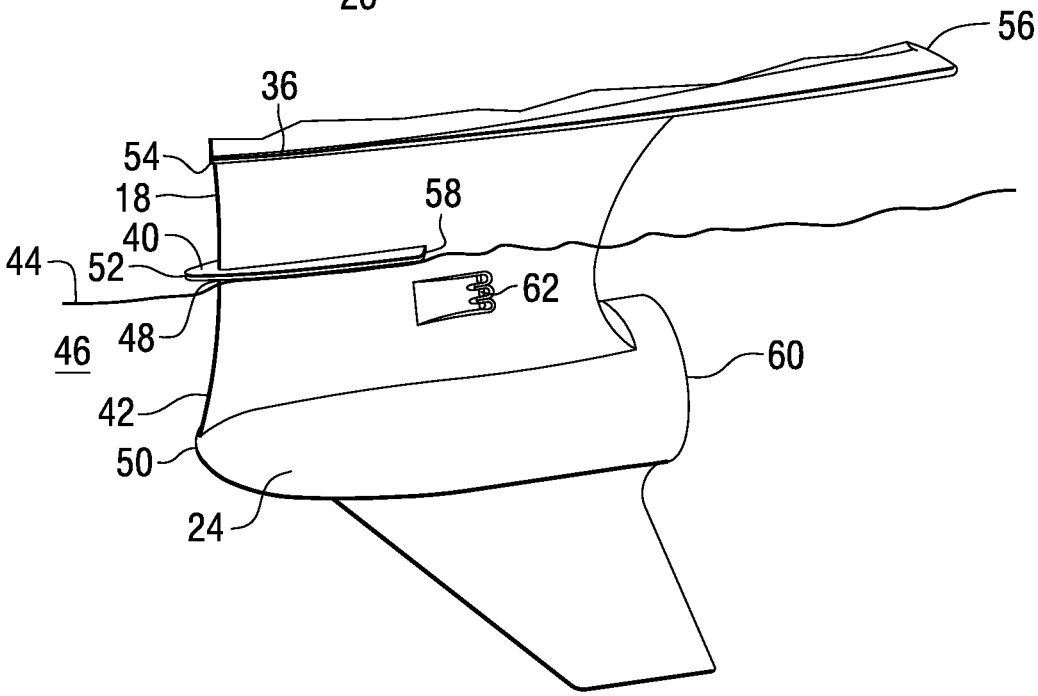
FIG. 2 shows a portion of a marine drive in accordance with the present disclosure.

FIG. 2 illustrates an embodiment of the present disclosure and uses like reference numerals from above where appropriate to facilitate understanding. A spray shield or plate 40 is provided on strut 18 and spaced above torpedo 24 and below anti-ventilation plate 36. Spray shield 40 reduces wetted surface area along the portion of strut 18 thereabove, including between spray shield 40 and anti-ventilation plate 36, to reduce drag. Strut 18 has a front edge 42 piercing the surface 44 of a body of water 46 in which the marine drive is operating. Front edge 42 pierces surface 44 at a pierce point 48 along front edge 42 vertically between torpedo 24 and anti-ventilation plate 36. Further, pierce point 48 is vertically between torpedo 24 and spray shield 40.

Torpedo 24 has a leading forward end 50, and in the embodiment of FIG. 2 is fully submerged in body of water 46 below surface 44. Spray shield 40 has a leading forward end 52 and in the embodiment of FIG. 2, leading forward 52 is vertically aligned with leading forward end 50 of the torpedo. Anti-ventilation plate 36 has a leading forward end 54 and in the embodiment of FIG. 2 all three of the leading forward ends 54, 52, 50 of the anti-ventilation plate, spray shield and torpedo, respectively, are vertically aligned.

Anti-ventilation plate 36 has an aft end 56. Spray shield 40 has an aft end 58 which in the embodiment of FIG. 2 is spaced forwardly of aft end 56 of the anti-ventilation plate 36. Torpedo 24 has an aft end 60. In the embodiment of FIG. 2 the aft end 58 of the spray shield is spaced forwardly of the aft end 60 of the torpedo.

Torpedo 24 extends horizontally fore to aft. In the embodiment of FIG. 2, spray shield 40 extends horizontally fore to aft and parallel to torpedo 24. Anti-ventilation plate 36 is a horizontal anti-ventilation plate extending horizontally fore to aft. Spray shield 40 in FIG. 2 is a horizontal spray shield plate extending horizontally fore to aft and parallel to horizontal anti-ventilation plate 36 thereabove. Horizontal anti-ventilation plate 36 has a greater fore to aft length than horizontal spray shield plate 40. Torpedo 24, spray shield 40, and anti-ventilation plate 36 each have the respective noted forward end and aft end. Aft end 60 of torpedo 24 is forward of aft end 56 of anti-ventilation plate 36 and aft of aft end 58 of spray shield 40.

It is known in the prior art to provide cooling water inlets along the sides of the marine drive gearcase lower strut for drawing in cooling water from the body of water in which the marine drive is operating. In FIG. 2, the gearcase has one or more cooling water inlets 62 along the strut for drawing in cooling water from the body of water 46. The one or more cooling water inlets 62 are vertically spaced between torpedo 24 and spray shield 40.

Figure 3:
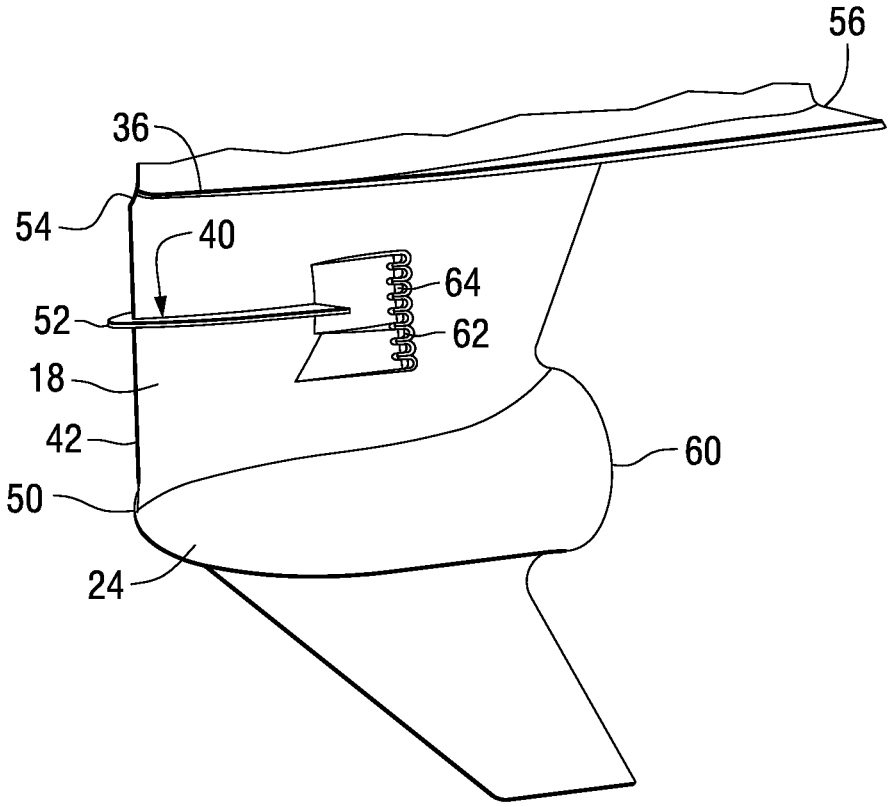
FIG. 3 is a perspective view showing another embodiment of a marine drive in accordance with the present disclosure.

FIG. 3 shows a further embodiment and uses like reference numerals from above where appropriate to facilitate understanding. The gearcase has a plurality of water inlets such as 62, 64 along the strut for drawing in cooling water from the body of water in which the marine drive is operating. At least one of the water inlets such as 62 is below spray shield 40. At least another of the water inlets such as 64 is above the spray shield 40. Water inlet 62 is below and aft of spray shield 40. Water inlet 64 is above and aft of spray shield 40.

Figure 4:
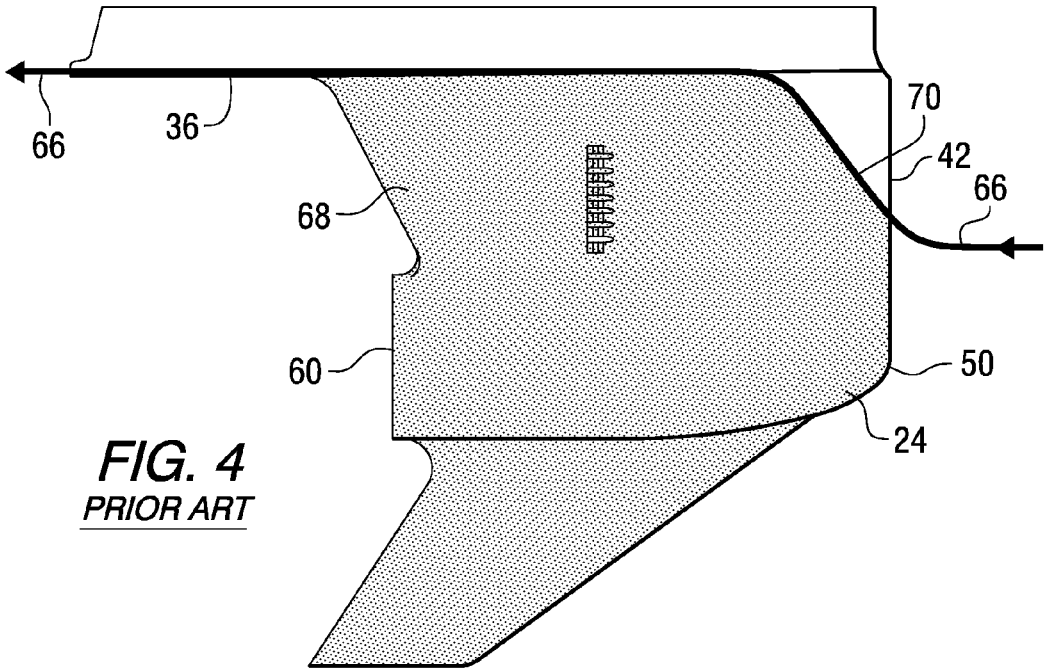
FIG. 4 PRIOR ART
FIG. 4 shows a portion of a marine drive in accordance with prior art.
Figure 5:
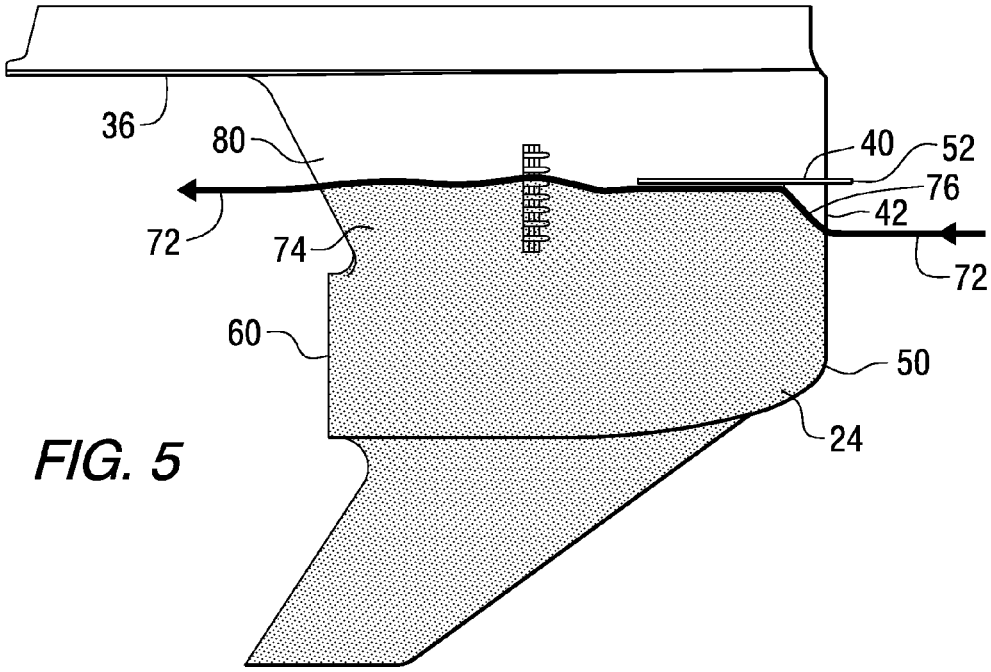
FIG. 5 is like FIG. 4 but illustrates the present disclosure.
Figure 6:
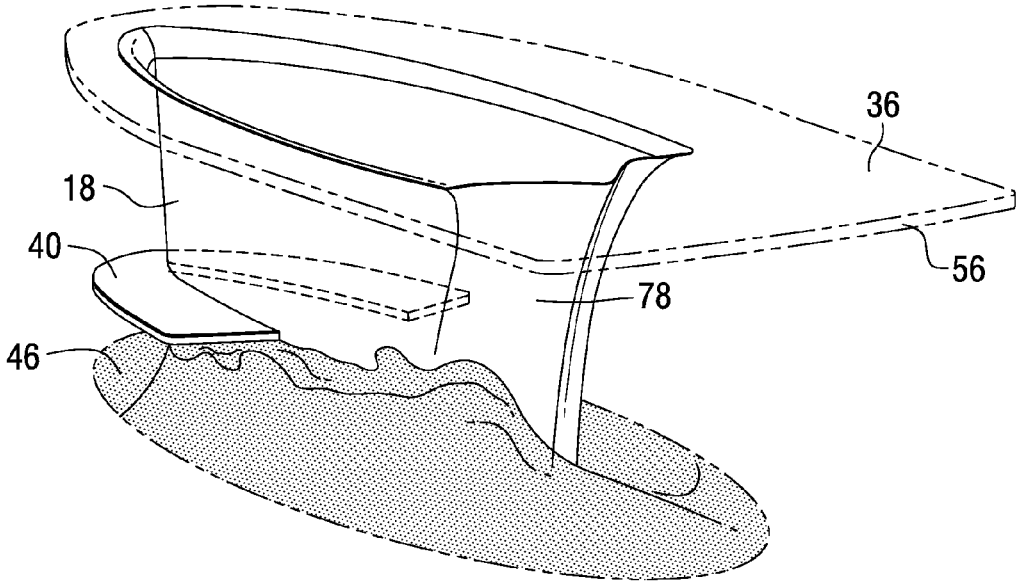
FIG. 6 is a perspective view from the rear showing a portion of the marine drive of FIG. 2.

FIGS. 4 and 5 use like reference numerals from above where appropriate to facilitate understanding, and illustrate the reduced wetted surface area and reduced drag afforded by the present disclosure. In FIG. 4, there is no spray shield plate along the strut, or if a spray shield plate is provided, it is spaced above the anti-ventilation plate 36. The water flow line is shown at arrows 66 and the wetted surface area is shown at cross-hatched lines 68. As seen, the water strikes forward leading edge 42 of the strut and may flow upwardly as shown at 70 and then against the underside of anti-ventilation plate 36. In contrast, in FIG. 5 a spray shield plate 40 is provided on the strut and is provided below anti-ventilation plate 36. The water flow line is shown at arrows 72, and the wetted surface area is shown at cross-hatched lines 74. The water flows against forward leading edge 42 of the strut and then flows upwardly as shown at 76 until it strikes the underside of spray shield plate 40 and then flows rearwardly therealong and does not flow further upwardly along the side of the strut, whereby the wetted surface area 74 in FIG. 5 is less than the wetted surface area 68 in FIG. 4, whereby to reduce drag. In the prior art, placing a splashguard or spray plate above anti-ventilation plate 36 keeps water off of the powerhead and transom assemblies thereabove but does not influence the flow of water along the gearcase strut below anti-ventilation plate 36. Placing spray shield plate 40 below anti-ventilation plate 36 not only reduces wetted surface area along the strut but also blocks flow against the underside of anti-ventilation plate 36 to further reduce drag. The present disclosure reduces skin friction drag along both the strut and along the underside of the anti-ventilation plate. The present disclosure facilitates venting of the strut trailing surface 78, FIG. 6, and reduces pressure drag and possible cavitation on the aft part of the strut. The disclosure reduces the likelihood of cavitation on the strut as water is no longer attached to the portion 80 of the strut just below the anti-ventilation plate, thus reducing cavitation induced drag. Reduced drag enables increased top end speed.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A marine drive comprising a lower drive unit including a gearcase with a downwardly depending vertical strut having a lower horizontal torpedo with an aft propeller, an anti-ventilation plate on said strut spaced above said torpedo to prevent entry of air to said propeller, a spray shield on said strut spaced above said torpedo and below said anti-ventilation plate, wherein said strut, has a front edge piercing the surface of a body of water in which the marine drive is operating, said front edge piercing said surface at a pierce point along said front edge vertically between said torpedo and said anti-ventilation plate, said pierce point is vertically between said torpedo and said spray shield, said anti-ventilation plate has an aft end, and said spray shield has an aft end spaced forwardly of said aft end of said anti-ventilation plate.

2. The marine drive according to claim 1 wherein said torpedo has an aft end, and said aft end of said spray shield is spaced forwardly of said all end of said torpedo.

3. A marine drive comprising a lower drive unit including a gearcase with a downwardly depending vertical strut having a lower horizontal torpedo with an aft propeller, an anti-ventilation plate on said strut spaced above said torpedo to prevent entry of air to said propeller, a spray shield on said strut spaced above said torpedo and below said anti-ventilation plate, wherein said strut has a front edge piercing the surface of a body of water in which the marine drive is operating, said front edge piercing said surface at a pierce point along said front edge vertically between said torpedo and said anti-ventilation plate, said pierce point is vertically between said torpedo and said spray shield, said torpedo, said spray shield, and said anti-ventilation plate each has a forward end and an aft end, and wherein said aft end of said torpedo is forward of said aft end of said anti-ventilation plate, and said aft end of said torpedo is aft of said aft end of said spray shield.

4. A marine drive comprising a lower drive unit including a gearcase with a downwardly depending vertical strut having a lower horizontal torpedo with an aft propeller, an anti-ventilation plate on said strut spaced above said torpedo to prevent entry of air to said propeller, a spray shield on said strut spaced above said torpedo and below said anti-ventilation plate, wherein said strut has a front edge piercing the surface of a body of water in which the marine drive is operating, said front edge piercing said surface at a pierce point along said front edge vertically between said torpedo and said anti-ventilation plate, said pierce point is vertically between said torpedo and said spray shield, said gearcase has a plurality of water inlets along said strut for drawing cooling water from said body of water, at least one of said water inlets being below said spray shield, at least another of said water inlets being above said spray shield.

5. The marine drive according to claim 4 wherein said one of said water inlets is below and aft of said spray shield, and said other of said water inlets is above and all of said spray shield.

* * * * *